US007384467B2

(12) United States Patent
Pluschke et al.

(10) Patent No.: US 7,384,467 B2
(45) Date of Patent: Jun. 10, 2008

(54) MODIFIED CEREAL FLOUR FOR PAPER MANUFACTURE

(75) Inventors: Frank Pluschke, Braunschweig (DE); Sigurd Witt, Nordhom (DE); Jan-Peter Maczynski, Wolfenbuttel (DE)

(73) Assignee: Muhle Runingen GmbH & Co. KG, Braunschweig (DE)

( * ) Notice: Subject to any disclaimer, the term of this patent is extended or adjusted under 35 U.S.C. 154(b) by 119 days.

(21) Appl. No.: 10/558,762

(22) PCT Filed: May 21, 2004

(86) PCT No.: PCT/EP2004/005476

§ 371 (c)(1),
(2), (4) Date: Nov. 30, 2005

(87) PCT Pub. No.: WO2004/108813

PCT Pub. Date: Dec. 16, 2004

(65) Prior Publication Data

US 2007/0017504 A1 Jan. 25, 2007

(30) Foreign Application Priority Data

Jun. 4, 2003 (DE) ..... 103 25 535

(51) Int. Cl.
*C08L 3/06* (2006.01)
*C08L 89/00* (2006.01)
*C09D 103/06* (2006.01)
*C09D 189/00* (2006.01)

(52) U.S. Cl. ..... 106/128.1; 106/207.1; 106/207.3; 162/174

(58) Field of Classification Search ..... 106/128.1, 106/207.1, 207.3; 162/174
See application file for complete search history.

(56) References Cited

U.S. PATENT DOCUMENTS 3,269,855 A * 8/1966 Moes et al. ..... 428/535
3,843,377 A * 10/1974 Alexander ..... 106/128.1
4,155,884 A 5/1979 Hughes

FOREIGN PATENT DOCUMENTS

DE 43 44 139 A1 6/1995
DE 197 29 272 A1 1/1999
DE 103 25 535 A1 12/2004

* cited by examiner

*Primary Examiner*—David M Brunsman
(74) *Attorney, Agent, or Firm*—Salter & Michaelson

(57) ABSTRACT

The invention relates to modified wheat flour containing sodium metaphosphate $Na_n[P_nO_{3n}]$ for increasing the suspension stability of the flour. According to the invention, said modified wheat flour can be used as a substitute for starch in paper production.

21 Claims, No Drawings

MODIFIED CEREAL FLOUR FOR PAPER MANUFACTURE

This application is a 371 of PCT/EP04/05476, filed 21 May 2004.

TECHNICAL FIELD

The present invention relates to a modified cereal flour with improved suspension properties such as can be used for paper manufacture in particular and also a process for the production of the modified cereal flour and its use for paper manufacture.

The present invention is particularly suitable for use in conventional processes for the manufacture of paper, paperboard or cardboard, and for generally known devices usually used for this. The present invention is suitable in particular for the manufacture of recycled paper.

BACKGROUND OF THE INVENTION

In paper manufacture, a fibre slurry is firstly produced, which is an aqueous suspension comprising starting materials such as fibrous constituents and possibly further papermaking auxiliary agents. This papermaking stock is passed in web form onto a belt-type screen containing drainage elements. After partial drainage the web passes through a so-called sizing press, in which starch is applied as sizing agent to the partially dried web in the form of an aqueous suspension to increase the tear resistance of the paper to be manufactured.

Since the starch in question is a processed product, which is relatively expensive to produce and is thus associated with corresponding costs, it was desirable to replace the starch with a cheaper raw material.

Thus, it is proposed in DE 43 44 139 A1 to substitute cereal flour such as rye flour, for example, for the starch, wherein the cereal flour is extruded to homogenise it and is then ground to a powdered product. Extrusion serves to prevent lump formation during the necessary dispersion of the cereal flour for use in paper manufacture.

To assure an undisturbed operation for the paper manufacture and additionally constant quality of the paper obtained, it is necessary that an even homogeneous application of the aqueous suspension serving as sizing agent is assured over longer periods of operation. Moreover, no sedimentation should occur in the suspension.

Therefore, an aqueous suspension of cereal flour, such as that to be used as sizing agent in paper manufacture, for example, should have a high suspension stability, wherein there should also be no substantial change in viscosity over a longer period of time and moreover no, or substantially no, sedimentation should occur.

DE 197 29 272 relates to starch-based thermoplastic mixtures, wherein starch is modified with a phosphate, amongst others sodium trimetaphosphate, and the components are mixed by application of thermal and mechanical energy preferably at elevated temperature and with simultaneous exertion of shearing forces. The mixing can be conducted in conventional single- and double-screw extruders.

The aim was to obtain starch-based moulding materials, which exhibit a thermoplastic behaviour enabling them to be processed by means of known plastic processing techniques to form mouldings with adequate mechanical properties such as, for example, an adequate strength and a sufficient dimensional stability.

Moreover, it is stated that the obtained products can be used, inter alia, as adhesives for paper and corrugated cardboard. Adhesives are used to glue individual paper layers, as is necessary, for example, in the manufacture of corrugated cardboard from several paper layers.

However, no further details are given regarding the suitability for paper manufacture, in particular for sizing.

OBJECTS OF THE INVENTION

The object of the invention was to provide a modified cereal flour, which has an improved suspension stability.

In particular, the object of the invention was to provide a modified cereal flour, which has an improved suspension stability, and can therefore also be used advantageously for paper manufacture.

This object is achieved according to the invention by a modified cereal flour, which contains cereal flour and sodium metaphosphate, wherein the modified cereal flour can be obtained by extrusion of the cereal flour and the sodium metaphosphate.

SUMMARY OF THE INVENTION

It was found according to the invention that the suspension stability of cereal flour can be increased considerably by adding sodium metaphosphate. As a result, cereal flour, in particular in extruded form, can be advantageously used as substitute for starch in paper manufacture. The modified cereal flour according to the invention is particularly suitable for use as sizing agent such as is conventionally applied to a paper web via a sizing press in paper manufacture.

DETAILED DESCRIPTION OF THE PREFERRED EMBODIMENT

Sodium metaphosphate has the total formula $Na_n[P_nO_{3n}]$, wherein for the present invention n can be 3, 4 or 5, and n=3 is particularly preferred. Sodium metaphosphate can be used in the commercially available form for the present invention. Hereinafter, "sodium metaphosphate" is also referred to as "SMP" and "sodium trimetaphosphate" as "STP".

According to the invention, the modified cereal flour usually contains 0.5 to 5% by weight of SMP relative to the cereal flour, wherein the natural water content of cereal flour has not been excluded from the calculation.

Preferably, the modified cereal flour according to the invention contains SMP in a quantity of 0.5 to 3% by weight, in particular 0.8 to 2.5% by weight.

According to the invention, any cereal flour can be used in principle. However, the cereal flour should contain as high a starch content as possible. Suitable examples are rye flour and wheat flour.

Rye flour or a flour of a type of cereal, in which the starch content and composition of the starch corresponds to or is similar to that of rye as well as mixtures thereof, are particularly preferred. Rye flour is preferably used.

A generally commercially available flour can be used for the cereal flour.

The modified cereal flour according to the invention can additionally contain water. This water can either come from the natural content of the flour and/or be added during the course of the production process and not have been fully removed during the subsequent drying.

In a preferred embodiment, the water content of the modified cereal flour lies at 13% by weight or less, in particular at 10% by weight or less, relative to the content of modified cereal flour.

For use, the modified cereal flour according to the invention is provided in particle form as a powder or granulate.

A suitable particle size lies at less than 300 μm, in particular at less than 300 μm to about 250 μm.

The production of the modified cereal flour according to the invention is preferably conducted by mixing the components with an extruder. According to a preferred embodiment, a double-screw extruder is used.

For this, all components, flour and SMP, are added to the extruder individually and/or mixed completely or partially with one another. Water is usually also added for the extrusion. The water content is determined according to requirement in each case. A suitable water content usually lies in the range of 10 to 50% by weight relative to the content of cereal flour. The water content preferably lies in a range of 20 to 40%, and in particular 20 to 35% by weight.

The extrusion temperature is usually higher than 65° C., so that the starch contained in the cereal flour is sufficiently sized and thus fundamentally soluble.

The extrudate obtained can be subjected to usual further processing, depending on requirement, such as cooling, drying and crushing to a suitable particle size, for example. The generally known materials for these processing steps can be used for this.

The modified cereal flour according to the invention can serve as a substitute for the starch in a sizing agent for paper manufacture. For this, an aqueous suspension of suitable concentration is produced from the modified cereal flour according to the invention, and this can then be used for paper manufacture.

For use in a sizing press, the viscosity of the aqueous suspension with the modified cereal flour according to the invention should amount to less than 100 mPa, so that the suspension is sufficiently flowable. At a higher viscosity the suspension may be ejected from the sizing press because of lacking flowability.

Depending on the type of paper to be manufactured, further additions to the suspension known for paper manufacture can be added to the modified cereal flour according to the invention during the course of the extrusion, but only so long as these are not detrimentally affected by the conditions of extrusion.

Examples of usual additions are dyes, auxiliary agents, fillers, retention agents etc.

The production of the material according to the invention is explained in more detail below by way of examples.

To conduct the examples, a conventional rye flour of Type 815 as well as sodium trimetaphosphate, which is available commercially under the trade name Rhodia-PH05-M1-EM-PIP-HOS-STP/D, were used.

A Bühler BCTG double-screw extruder with an L/D20 housing diameter was used with a BCTC pre-conditioner, also from Bühler, connected upstream of it.

The flour and the sodium trimetaphosphate were fed to the extruder via the pre-conditioner.

A portion of the water was also fed via the pre-conditioner and a further portion added directly to the extruder.

Sodium trimetaphosphate mixed with a portion of the flour was added as powder mix. The corresponding quantities and process conditions are shown in the following Table 1. The extension temperature lay at about 200° C. and the mass pressure at about 33 bar.

The extrudates obtained were dried and had an average particle size of about 250 μm to 300 μm.

To examine the viscosity change in suspension and the sedimentation properties, a 6% suspension was formed from the cooled and ground extrudates obtained by means of a rod-type mixer, wherein the water content of the extrudate itself was not taken into consideration. The temperature of the suspension was set at 60° C. The viscosity was then measured at 100 revolutions per minute (rpm) with a spindle 1 of a Brookefield RV-DVIII measuring device.

In this case, the viscosity was measured directly after preparation of the suspension and after 24 hours. The sedimentation was also measured after 24 hours. The results are shown in Table 2.

As may be seen from Table 2, the viscosity remained substantially stable and no sedimentation was evident.

These results clearly show that by adding sodium trimetaphosphate the stability of flour in suspension can be improved and sedimentation when standing for a longer period can be prevented.

| | Test Number | | | |
|---|---|---|---|---|
| | 1 | 2 | 3 | 4 |
| Raw material | rye flour 815 | rye flour 815 | rye flour 815 | rye flour 815 |
| Screw speed [rpm] | 550 | 550 | 450 | 650 |
| Mass pressure [bar] | 33-35 | 33-35 | 33-34 | 33 |
| Extrusion temperature [° C.] | 201-205 | 202-204 | 199-201 | 195-201 |
| Cutter speed [%] | 1500 | 1500 | 1500 | 1500 |
| Addition of flour [kg/h] | 180 | 160 | 160 | 180 |
| Addition of water [kg/h] | 10 | 10 | 10 | 20 |
| Addition of water PC: pre-conditioner [kg/h] | 15 | 15 | 15 | 15 |
| STP/flour mix [kg/h] | 22 | 44 | 44 | 22 |
| STP [%] | 1 | 2 | 2 | 1 |
| Viscosity after suspension [mPs] | 51 | 55 | 69 | 84 |
| After 24 h [mPs] | 59 | 62 | 75 | 72 |
| Sedimentation after 24 h | — | — | — | — |

The invention claimed is:

1. Modified cereal flour containing cereal flour and sodium metaphosphate $Na_n[P_nO_{3n}]$, wherein the modified cereal flour can be obtained by extrusion of the flour and sodium metaphosphate and further characterised in that the water content added during the extrusion lies in a range of 10% to 50% by weight relative to the content of cereal flour.

2. Modified cereal flour according to claim 1, characterised in that n in the total formula is 3, 4 or 5.

3. Modified cereal flour according to claim 1, characterised in that the cereal flour is rye flour.

4. Modified cereal flour according to claim 1, characterised in that the water content of the modified cereal flour does not exceed 13% by weight relative to the modified cereal flour.

5. Modified cereal flour according to claim 1, characterised in that the modified cereal flour contains 1 to 2% by weight of sodium metaphosphate and not more than 13% by weight of water, wherein the modified cereal flour can be obtained by extrusion of the cereal flour and sodium metaphosphate with the addition of water.

6. Modified cereal flour according to claim 1 used for paper manufacture.

7. Modified cereal flour according to claim 6, characterised in that the cereal flour is rye flour.

8. Modified cereal flour according to claim 1 characterized in that n in the total formula is 3.

9. Modified cereal flour according to claim 1 characterized in that n in the total formula is 3, 4 or 5 and that the cereal flour is rye flour.

10. Modified cereal flour according to claim 1 characterized in that the water content of the modified cereal flour is at a maximum of 10% by weight relative to the modified cereal flour.

11. Modified cereal flour according to claim 1 characterized in that the modified cereal flour contains 0.5 to 5% by weight of sodium metaphosphate.

12. Modified cereal flour according to claim 11 characterized in that the modified cereal flour contains 0.5 to 3% by weight of sodium metaphosphate.

13. Modified cereal flour according to claim 12 characterized in that the modified cereal flour contains 0.8 to 2.5% by weight of sodium metaphosphate.

14. Modified cereal flour according to claim 1 characterized in that the water content added to the extrusion lies in a range of 20 to 40% by weight relative to the cereal flour.

15. Modified cereal flour according to claim 1 characterized in that the water content added to the extrusion lies in a range of 20 to 35% by weight relative to the cereal flour.

16. Process for the production of a modified cereal flour containing cereal flour and sodium metaphosphate and further characterised in that the cereal flour is subjected to extrusion together with sodium metaphosphate and water and further characterised in that the water content added during the extrusion lies in a range of 10% to 50% by weight relative to the content of cereal flour.

17. Process according to claim 16, characterised in that rye flour is used as cereal flour.

18. Process according to claim 16 characterized in that the extrusion temperature is greater than 65° C.

19. Process according to claim 16 characterized in that the water content of the modified cereal flour does not exceed 13% by weight relative to the modified cereal flour.

20. Process according to claim 16 characterized in that the water content added for the extrusion lies in a range of 20 to 35% by weight relative to the cereal flour.

21. Process according to claim 16 characterized in that the water content added for the extrusion lies in a range of 20 to 40% by weight relative to the cereal flour.

* * * * *